US005194011A

United States Patent [19]

Yeakley et al.

[11] Patent Number: 5,194,011

[45] Date of Patent: Mar. 16, 1993

[54] ROTATING FLEXIBLE INTERCONNECT

[75] Inventors: Lester M. Yeakley, Estes Park; Clark M. Janssen, Boulder, both of Colo.

[73] Assignee: Storage Technology Corporation, Louisville, Colo.

[21] Appl. No.: 825,122

[22] Filed: Jan. 24, 1992

[51] Int. Cl.[5] ..... H01R 35/00

[52] U.S. Cl. ..... 439/162; 439/13

[58] Field of Search ..... 439/162, 164, 13, 31-33

[56] References Cited

U.S. PATENT DOCUMENTS 3,597,721 8/1971 Mangan ..... 439/164

5,040,989 8/1991 Bannai ..... 439/164

FOREIGN PATENT DOCUMENTS 0518098 2/1940 United Kingdom ..... 439/164

*Primary Examiner*—Eugene F. Desmond

*Attorney, Agent, or Firm*—Sterne, Kessler, Goldstein & Fox

[57] ABSTRACT

The invention is a flexible interconnection which is used to transmit electrical signals across a rotatable mechanical coupling in a mechanical system. The mechanical system includes a first member defining a first surface and a second member defining a second surface. The first and second members are coupled for rotation in a plane of rotation about an axis. The first and second surfaces are juxtaposed. The interconnection includes a flexible cable which is fixedly attached to a first point on the first surface and a second point on the second surface. A "U" shaped portion of cable is formed between the two points of attachment. The "U" shaped portion has a first longitudinal portion which is substantially parallel to the plane of rotation, a second longitudinal portion which is substantially parallel to the plane of rotation, and a curved portion connecting the first and second longitudinal portions. The curved portion defines a central line of the bend which is substantially parallel to the plane of rotation. The "U" shaped portion is disposed between the first and second members such that the central line of the bend is located a distance r from the axis, where r is substantially equal to 1.092 times distance d. This allows smooth rotation of the interconnection.

15 Claims, 10 Drawing Sheets

ROTATING FLEXIBLE INTERCONNECT

FIELD OF THE INVENTION

This invention relates generally to the field of robotics. More specifically, the invention relates to electrical interconnections between bodies exhibiting relative rotation.

BACKGROUND OF THE INVENTION

In robotics, industrial machinery, and other electromechanical systems, it is often required that electrical signals be transmitted across a rotating mechanical coupling. For example, a television camera mounted on a robot arm receives power and control signals from a control platform and returns data signals representative of the images being captured back to the control platform. The robot arm is coupled to the control platform via a rotating coupling which allows rotation of the robot arm about an axis. A flexible cable is used as the pathway for the electrical signals across the rotating coupling. This cable, which forms a rotatable electrical interconnection, must be specially configured so as not to restrict the freedom of motion of the rotating coupling.

A first commonly used rotatable interconnection, floppy interconnection 100, is shown in FIGS. 1(*a*) and (*b*). A first member 102 is coupled to a second member 104 via a hinge or coupling pin (not shown) to allow relative rotation around an axis 106. Floppy interconnection 100 provides a signal pathway between members 102,104.

Floppy interconnection 100 includes a flexible cable 108 and two strain-relief cable mounts (hereinafter, "strain-relief") 110. Flexible cable 108 is secured to first member 102 with a first strain-relief cable mount 110. Flexible cable 108 is secured to second member 104 with a second strain-relief 110. Flexible cable 108 forms a large loop portion 114 between the two strain-reliefs 110. Loop portion 114 includes enough "slack" or "slop" to allow rotation of member 104 with respect to member 102.

Floppy interconnection 100 has several problems associated with it. First, loop 114 is susceptible to becoming tangled or snagged on nearby objects. Second, strain-reliefs 110 tend to concentrate stresses on the portions of the cable directly beneath the strain-relief points such that these areas are common points of failure. Third, when the system including members 102,104 is subjected to rapid accelerations or decelerations, loop 114 tends to flop freely about, magnifying the stresses on the cable at the strain-relief points. Finally, because of its inexact nature, it is very difficult to predict the reliability of floppy interconnection 100.

A second commonly used rotatable interconnection, coil interconnection 200, is shown in FIGS. 2(*a*) and 2(*b*). Coil interconnection 200 is shown in the environment of first member 102 and second member 104 as described above. First member 102 is rotatably coupled to second member 104 via a coupling or hinge pin 202. Coupling pin 202 allows rotation about axis 106. Coil interconnection 200 includes a flexible coil 204 of cable 206. Coil 204 is centered about axis 106. A first end of cable 206 is secured to member 102 via a strain-relief 110. A second end of cable 206 is secured to member 104 via a second strain-relief 110. Coil 204 is hung from a third member 208 using a third strain-relief 110.

Coil interconnection 200 has several problems associated with it. First, like loop 114 of floppy interconnection 100, coil 204 is susceptible to becoming tangled or snagged on nearby objects. Second, coil 204 must be centered on axis 106. This is not always possible. Third, coil 204 tends to be bulky, requiring a lot of space. Finally, it is difficult to predict the reliability of coil interconnection 200.

A third possible rotatable interconnection, wiper-type interconnection 300, is shown in FIG. 3. Wiper-type interconnection 300 works on the same principle as the brushes of a DC motor which provide power to the rotor windings. Wiper-type interconnection 300 is shown in the environment of first member 102 and second member 104 as described above. First member 102 is rotatably coupled to second member 104 via a hinge or coupling pin 302. Pin 302 is fixedly attached to member 104 and is adapted to rotatably mate with opening 304 in member 102. Wiper-type interconnection 300 includes a wiper or brush assembly 306 and a plurality of conductive tracks 308. Tracks 308 are disposed on pin 302. Wiper assembly 306 includes a plurality of conductive brushes 310 which are adapted to make ohmic contact with conductive tracks 308. Each conductive track 308 and brush 310 pair forms a single conductor rotating interconnection. A plurality of wires 312 provides electrical connection to wiper assembly 306. A plurality of wires 314 provides electrical connection to conductive tracks 308. Wires 312,314 are attached to members 102,104, respectively, by strain-reliefs 110.

Wiper-type interconnection 300 has several problems associated with it. First, the interconnection can become quite large and complex for a large number of conductors. Second, the brushes are relatively delicate and are susceptible to frictional wear.

What is needed is a compact rotatable interconnection which is not susceptible to tangling, is reliable, and allows straight-forward reliability predictions.

SUMMARY OF THE INVENTION

The invention is a flexible interconnection which is used to transmit electrical signals across a rotatable mechanical coupling in a mechanical system. The mechanical system includes a first member defining a first surface and a second member defining a second surface. The first and second members are coupled for rotation in a plane of rotation about an axis. The first and second surfaces are juxtaposed.

The interconnection includes a flexible cable which is fixedly attached to a first point on the first surface and a second point on the second surface. A "U" shaped portion of cable is formed between the two points of attachment. The "U" shaped portion has a first longitudinal portion which is substantially parallel to the plane of rotation, a second longitudinal portion which is substantially parallel to the plane of rotation, and a curved portion connecting the first and second longitudinal portions.

The curved portion defines a central line of the bend which is substantially parallel to the plane of rotation and which is also substantially perpendicular to the first and second longitudinal portions. The "U" shaped portion is disposed between the first and second members such that the central line of the bend is located a distance r from the axis, where r is substantially equal to 1.092 times distance d.

The flexible cable is attached to the first and second members using strain-relief cable mounts. The cable mounts are optimally positioned to restrain the cable from extraneous motions while still allowing rotation over a fixed angle.

An advantage of the invention is that smooth rotation is achieved over a predetermined angle without binding. Further, the interconnection contains no areas of stress concentration which are highly susceptible to failure.

An additional advantage is that the reliability of the interconnection may be easily predicted.

Another advantage of the invention is that the interconnection is compact and therefore not readily susceptible to tangling.

BRIEF DESCRIPTION OF THE DRAWINGS

FIG. 1(*b*) is a top view of the sample mechanical system shown in FIG. 1(*a*).

FIG. 2(*b*) is a top view of the mechanical system shown in FIG. 2(*b*).

FIG. 5(*b*) is a perspective view of the rotatable interconnection of the invention shown in a counter-clockwise rotated position.

FIG. 5(*c*) is a perspective view of the rotatable interconnection of the invention shown in a clockwise rotated position.

FIG. 7(*b*) is an exploded view of a strain-relief cable mount.

FIG. 10(*b*) is a side view of the interconnection of the invention used in a mechanical system where the "U" shaped portion of the cable is restrained in its range of motions by a single adjacent surface.

DESCRIPTION OF THE PREFERRED EMBODIMENT

The invention is now described with reference to FIGS. 4–10, where like reference numbers are used to indicate like elements.

Figure 1A:
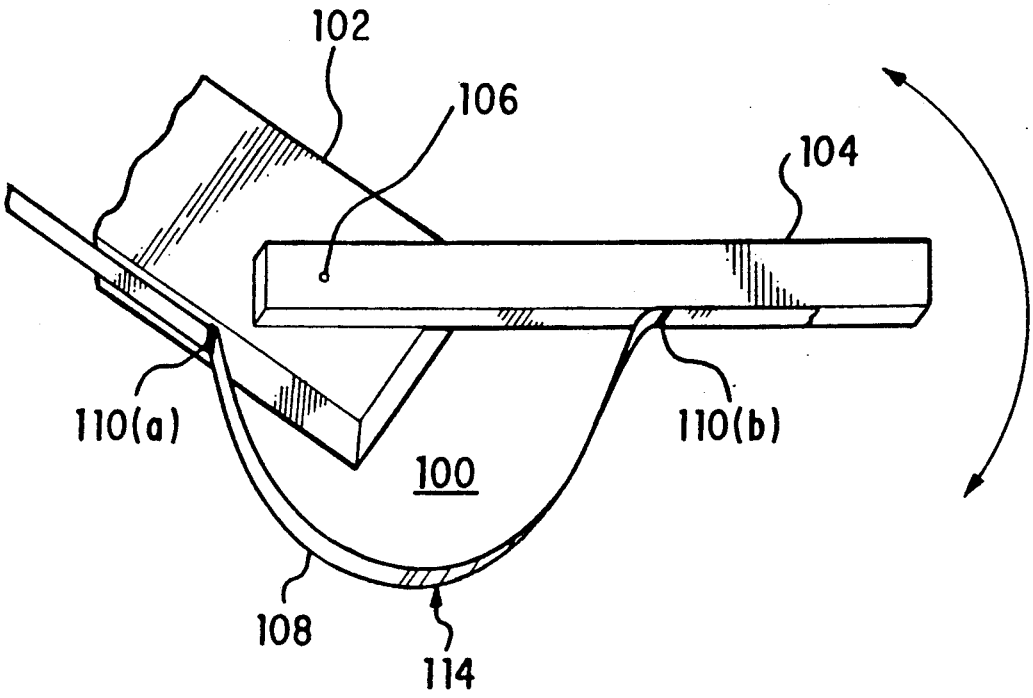
FIG. 1(*a*) is a perspective view of a sample mechanical system utilizing a conventional floppy-cable-type rotatable interconnection.
Figure 1B:
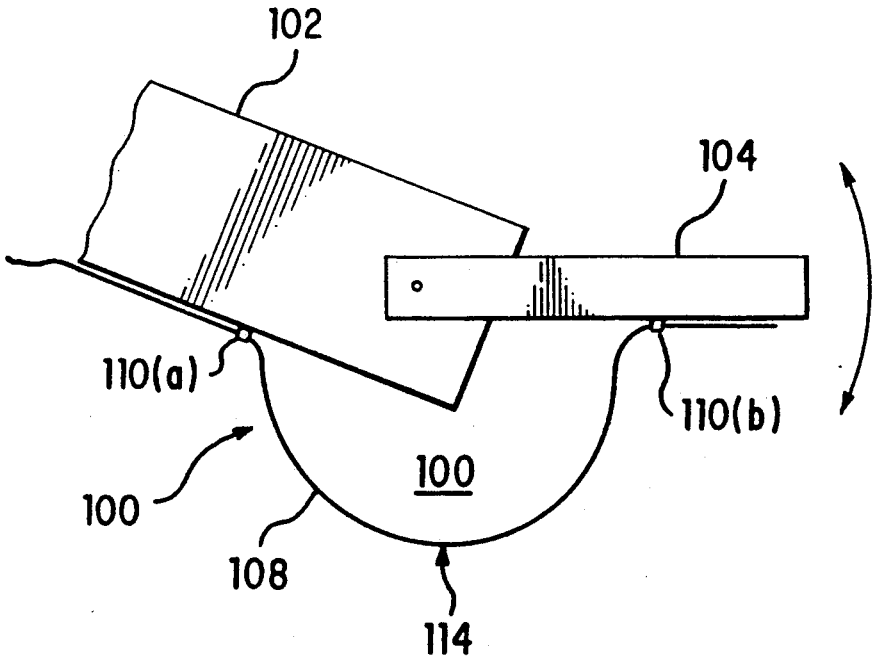
Figure 2A:
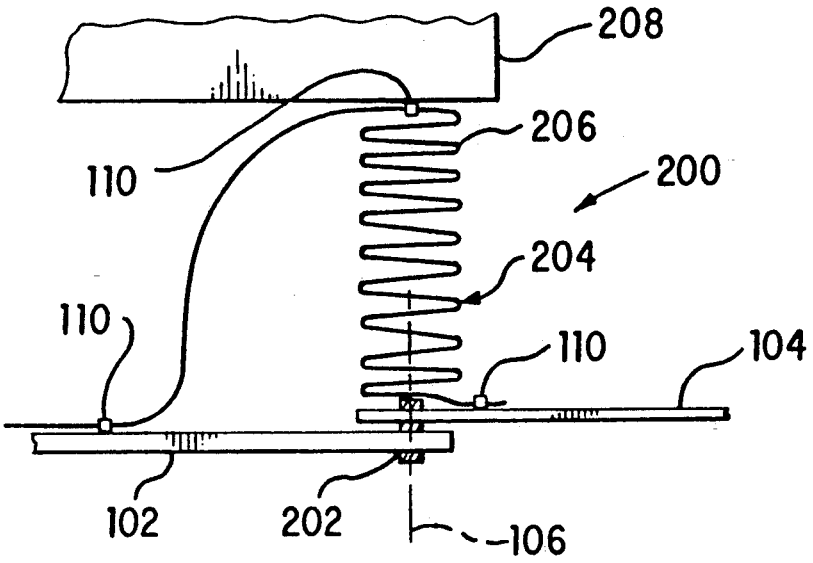
FIG. 2(*a*) is a side view of a mechanical system utilizing a conventional coil-type rotatable interconnection.
Figure 2B:
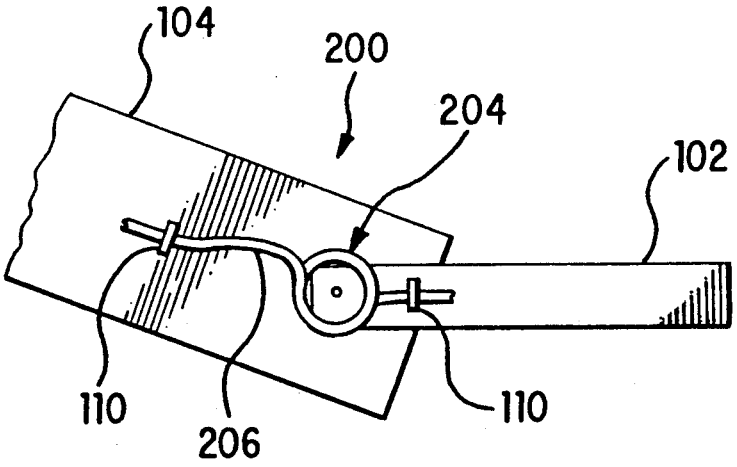
Figure 3:
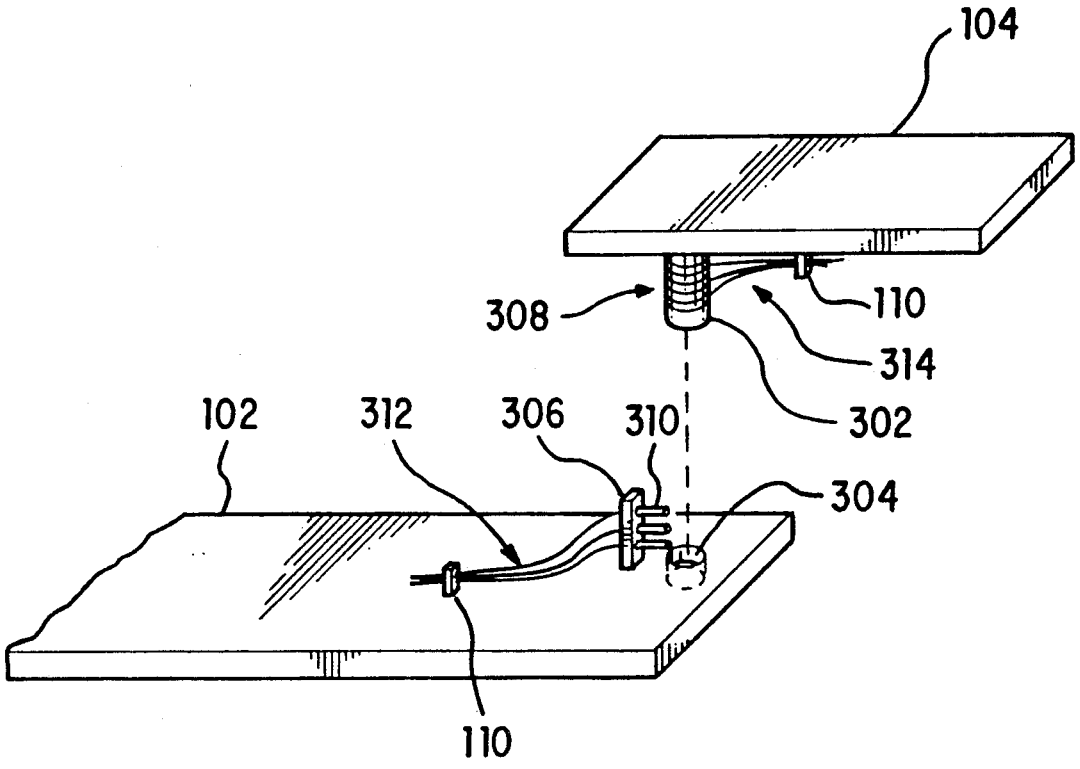
FIG. 3 is a perspective view of a sample mechanical system utilizing a conventional wiper-type rotatable interconnection.
Figure 4A:
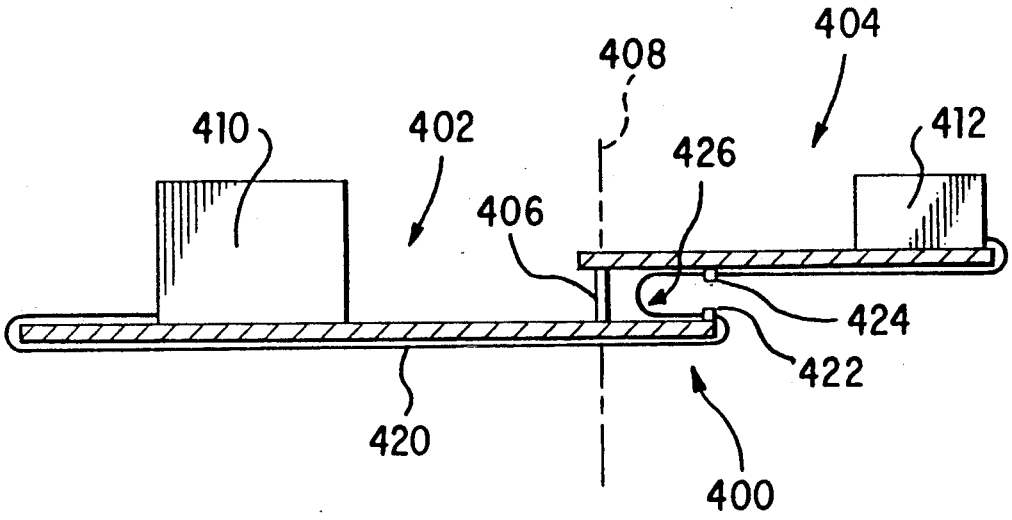
FIGS. 4(*a*) and (*b*) are side-views of a sample mechanical system utilizing the rotatable interconnection of the present invention.
Figure 4B:
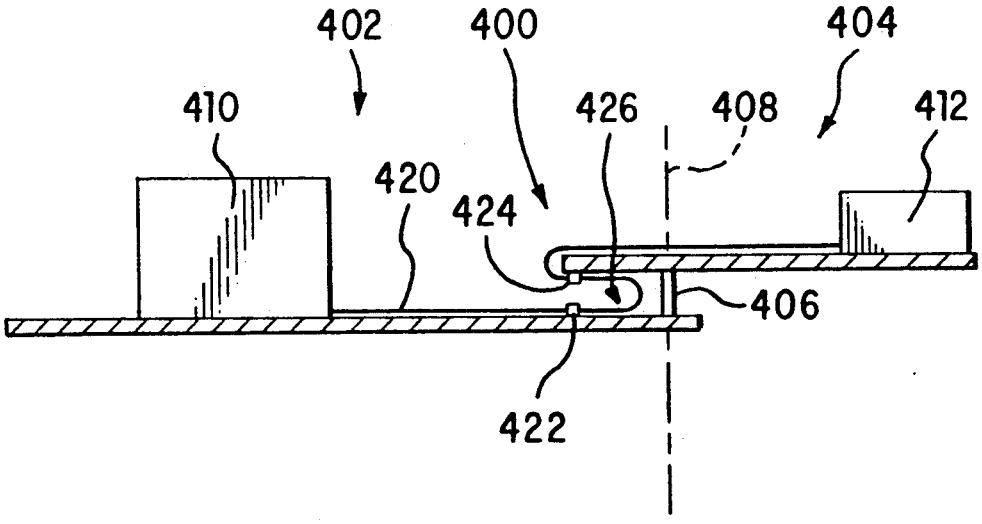

The rotatable interconnection 400 of the present invention is shown in FIG. 4. FIG. 4(*a*) shows a first embodiment of interconnection 400. FIG. 4(*b*) shows a second embodiment of interconnection 400. In both figures, interconnection 400 is shown in the environment of a first member 402 and a second member 404. First member 402 is rotatably coupled to second member 404 via a hinge or coupling pin 406. Pin 406 allows rotation about an axis of rotation 408.

First member 402 includes a first electronic assembly 410. Second member 404 includes a second electronic assembly 412. Interconnection 400 provides an electrical connection between assembly 410 and assembly 412 across the rotating mechanical coupling formed by pin 406.

Interconnection 400 includes a cable 420, a first strain-relief cable mount (hereinafter, "strain-relief") 422 and a second strain-relief 424. Strain-relief 422 secures cable 420 to member 402. Strain-relief 424 secures cable 420 to member 404. A portion 426 of cable 420 is formed into a "U" shape between strain-reliefs 422 and 424. "U" shaped portion 426 allows interconnection 400 to have unique rotating abilities.

"U" shaped portion 426 is sandwiched between a lower surface of second member 404 and an upper surface of first member 402. This helps to maintain portion 426 in a strict "U" shape.

Cable 420 is a thin flexible cable which can be bent into the required "U" shape and which is flexible enough to withstand the repetitive stresses caused by relative rotation between members 402, 404. It is preferred that cable 420 have a relatively flat or ribbon-like cross-section. This provides lateral stability to interconnection 420. Cable 420 may include a single conductor or a plurality of conductors. In the preferred embodiment, cable 420 is a flexible printed circuit (also known as "flex circuit"). Flex circuit is a thin, ribbon-like cable which is formed by sandwiching a plurality of copper traces between two layers of flexible insulating material, such as polyimide. Polyimide is available from E. I. DuPont De Nemours & Company, Wilmington, Del. Flex circuit is available as a made-to-order (i.e., customer supplied specifications) product from Rogers Corporation, Flexible Interconnections Division, Chandler, Ariz.

Alternatively, cable 420 may be a multi-conductor ribbon cable (available from W. L. Gore and Associates, Wilmington, Del.). Ribbon cables are well known in the electronics art. Cable 420 may also be a single conductor wire. A single conductor wire will probably not have the lateral stability required for optimal performance of interconnection 400.

Optical waveguides and/or fibers may be used for cable 420 if they are available with sufficient flexibility to meet the requirements of a particular application. This will allow flexible interconnect 400 to take advantage of the many benefits of optical communications.

Figure 5B:
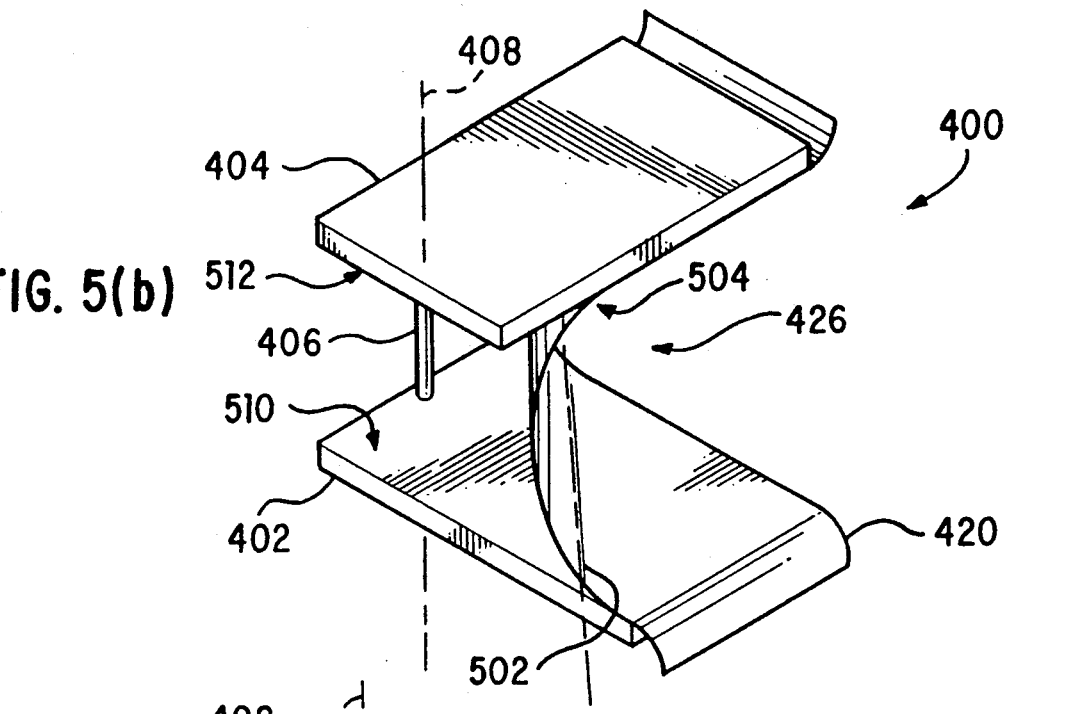
FIG. 5(*a*) is a perspective view of the rotatable interconnection of the invention shown in a centered position.
Figure 5A:
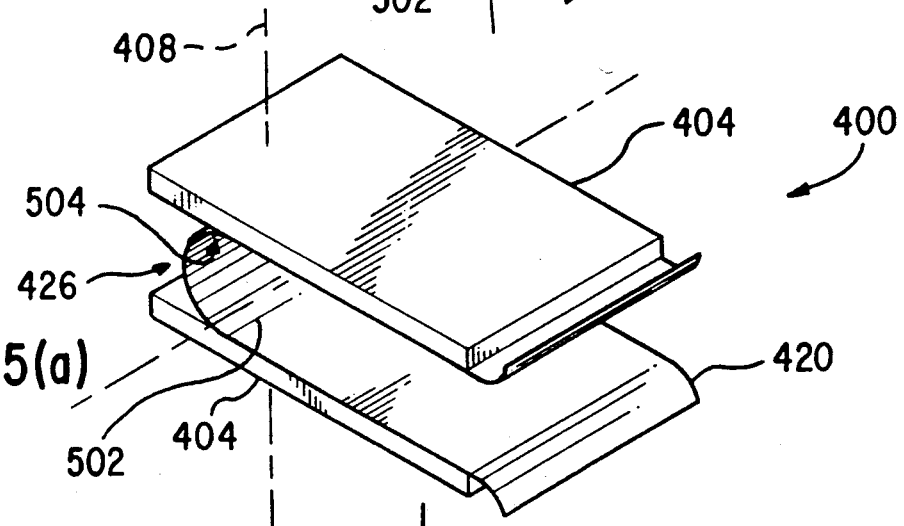
Figure 5C:
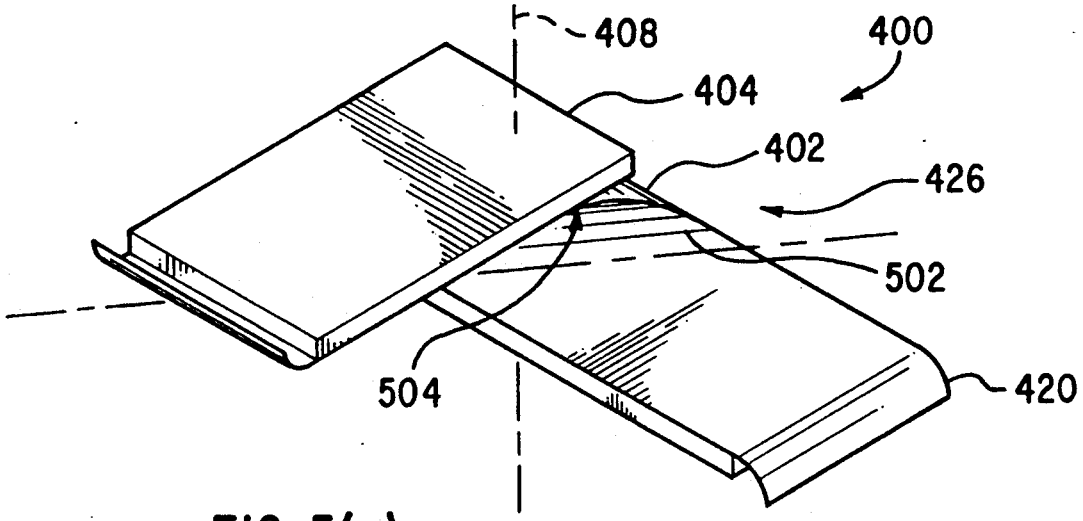

Operation of interconnection 400 is illustrated in FIG. 5. FIG. 5(*a*) shows interconnection 400 in a neutral or centered position. FIG. 5(*b*) shows interconnection 400 in a position resulting from member 404 being rotated counter-clockwise (as viewed looking down on the figure) with respect to member 402. FIG. 5(*c*) shows interconnection 400 in a position resulting from member 404 being rotated clockwise (as viewed looking down on the figure) with respect to member 402.

Member 402 has a surface 510 and member 404 has a surface 512 which are maintained in contact with cable 420. Surfaces 510, 512 are disposed in a juxtaposed (i.e., face-to-face) relationship. A line segment 502 indicates the area where cable 420 just lifts off from surface 510. Similarly, a line segment 504 indicates the area where cable 420 just lifts off from surface 512. Note that line segments 502, 504 are in different positions in FIGS. 5(*a*)-(*c*). This is caused by a twisting of cable 420 which occurs when interconnection 400 is rotated. This is discussed in greater detail below with reference to FIGS. 6-9.

Implementation of interconnection 400 involves proper placement of strain-reliefs 422, 424; proper positioning of "U" shaped portion 426 with respect to axis of rotation 408; and proper spacing of members 402 and 404. When properly implemented, interconnection 400 allows uniform relative rotation of members 402,404 over an angle of $\alpha$; the stresses on cable 420 are evenly distributed with no areas of stress concentration (such as the strain-relief areas of floppy interconnection 100 discussed above) which are highly susceptible to failure; cable 420 does not slide on the surfaces which it contacts so that frictional wear is minimized; the reliability of interconnection 400 is easily estimated because the motion of cable 420 is limited to a strict rolling motion; and interconnection 400 is compact and not susceptible to tangling or interference from nearby devices.

Figure 6:
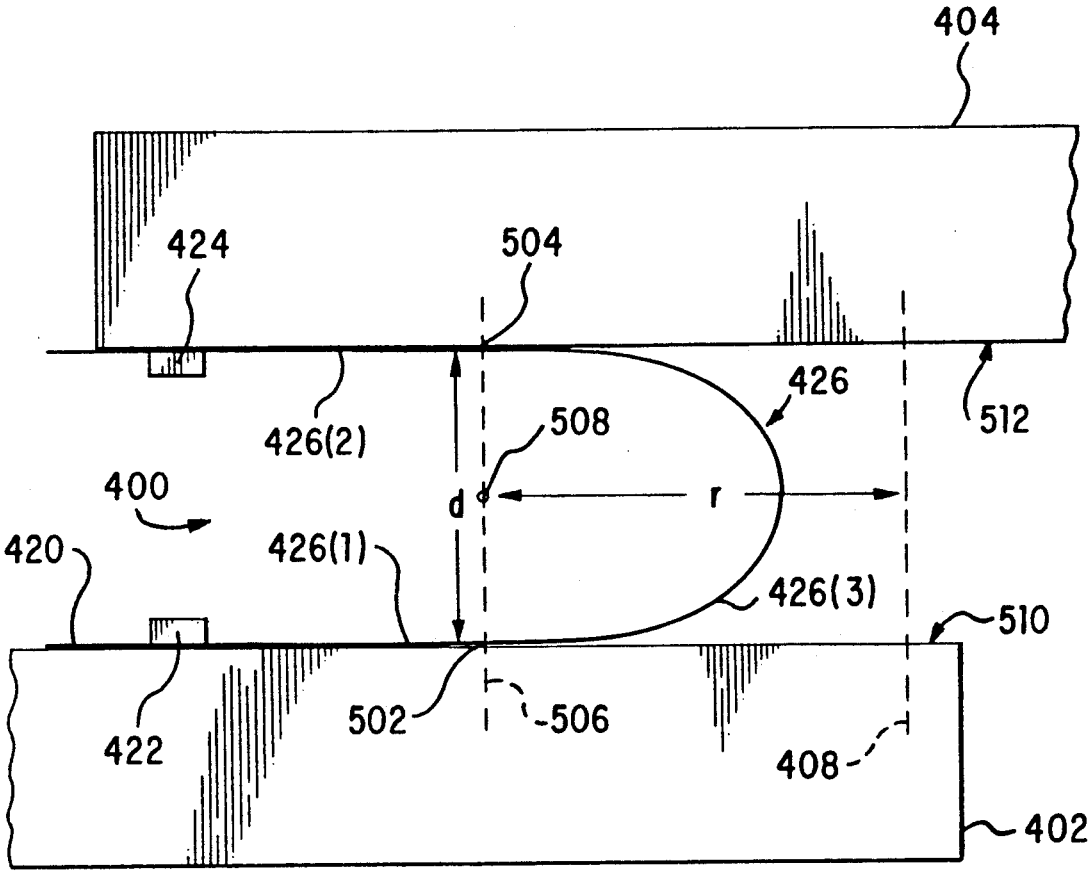
FIG. 6 is a side view of the rotatable interconnection of the invention.

Proper positioning of "U" shaped portion 426 with respect to axis of rotation 408 and proper spacing of members 402 and 404 are described with reference to FIG. 6. FIG. 6 is a cross-sectional side view of interconnection 400. The width W of cable 420 extends into the drawing sheet.

"U" shaped portion 426 of cable 420 is sandwiched between surface 510 of member 402 and surface 512 of member 404. Surfaces 510,512 are separated by a distance d which is measured between line segments 502,504. A first longitudinal portion 426(1) of "U" shaped portion 426 is maintained in contact with surface 510 of member 402. A longitudinal portion 426(2) of "U" shaped portion 426 is maintained in contact with surface 512 of member 404.

A curved portion 426(3) which interconnects longitudinal portions 426(1) and 426(2) is held in a characteristic curved shape by the inherent resiliency of cable 420 acting against surfaces 510,512. The "characteristic" curve results when a uniformly flexible beam is bent in the fashion shown in FIG. 6. Curved portion 426(3) is defined as the segment of cable 420 between line segments 502 and 504. As discussed above, line segments 502,504 mark the places on cable 420 which just separate or lift off from surfaces 510,512, respectively. A plane 506 is defined by line segments 502,504. Plane 506 is perpendicular to the drawing sheet of FIG. 6 when members 402,404 are aligned. Plane 506 defines a central line 508 of the bend. Central line 508 is located midway between surfaces 510,512 and is parallel to line segments 502,504.

For optimal performance of interconnection 400, "U" shaped portion 426 should be disposed between surfaces 510,512 such that the axis of rotation 408 is located a distance r from the central line 508 of the bend. Distance r is determined according to the following formula:

$$\begin{aligned} r &= \frac{1}{2} s \\ &= \frac{1}{2} (2.184) d \\ &= 1.092 d \end{aligned}$$

where:

s = the circumference of curved portion 426(3) = 2.184 d d = distance between surfaces 510,512

This formula was derived using finite element modeling with elastic beam elements. The finite element analysis may be performed on a general purpose computer running a finite element analysis program (e.g., ANSYS; available from Swanson Analysis Systems, Inc.). This formula for s will be true for any uniformly flexible material which is bent in a characteristic manner as shown.

Distance d should be made small enough to hold "U" shaped portion 426 in at least a slight state of compression. As distance d is increased, the stresses on cable 420 are decreased. However, if distance d is made too large, then cable 420 will begin to resemble, and suffer from the shortcomings of, floppy interconnection 100.

As distance d is decreased, the stresses on curved portion 426(3) of "U" shaped portion 426 are increased. If distance d is made too small, then the limit of elasticity of cable 420 may be exceeded at curved portion 426(3), and the life of the cable may be diminished.

An optimal distance d should be selected based on the flexibility and dimensions of cable 420. If distance d is fixed, then the parameters of cable 420 should be selected to achieve an optimal interconnection.

Further, it is preferred that surfaces 510,512 be substantially parallel to each other. This will correspondingly cause longitudinal portions 426(1) and 426(2) of cable 420 to be disposed substantially in parallel. While this is not required, it allows optimal functioning of interconnection 400.

The next important design parameter which must be selected is the positioning of strain-reliefs 422,424. If strain-reliefs 422,424 are ideally located, then interconnection 400 will be capable of rotation over a preselected angle $\alpha$, the motion of cable 420 will be restricted to that necessary for rotation, and no slack will be present in the cable. A "slack" or loosely restrained cable is susceptible to extraneous motions and stresses including lateral slipping or sliding over surfaces 510,512. Further, the lateral forces which cause slipping can be transmitted along cable 420 to strain-reliefs 422,424 to create a high-stress connection point which may result in premature failure of interconnection 400.

If strain-reliefs 422,424 are located too close to curved portion 426, then they will restrict the range of angular motion $\alpha$ provided by interconnection 400. If strain-reliefs 422,424 are located too far away from curved portion 426, then the they will introduce slack into cable 420.

Figure 7B:
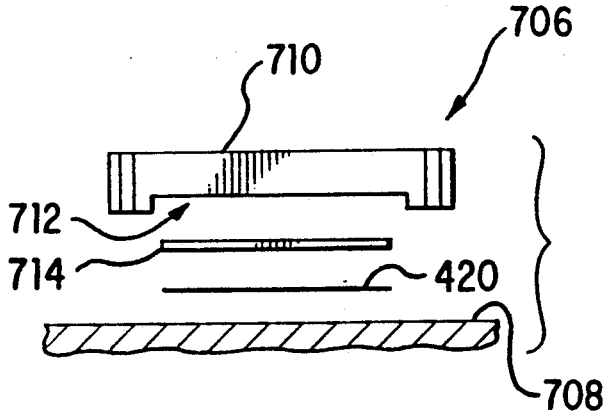
FIG. 7(*a*) is a top view of a flexible printed circuit secured to a surface by a strain-relief cable mount.
Figure 7A:
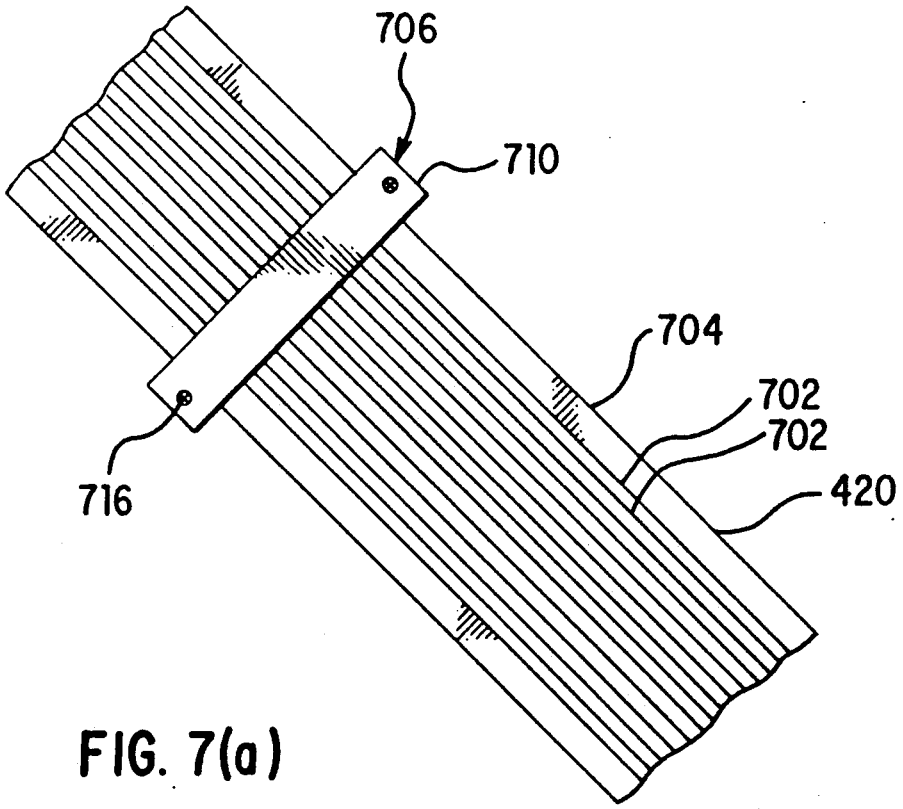

FIG. 7(*a*) shows a sample section of cable 420. As discussed above, the preferred embodiment of cable 420 is flexible printed circuit. Cable 420 includes a plurality of conductors 702 disposed on a flexible, insulating substrate 704. A sample embodiment 706 of strain-reliefs 422,424 is shown clamping cable 420 to a surface 708. Strain-relief 706, shown in FIG. 7(*b*), includes a rigid bracket 710. Rigid bracket 710 includes a recessed area 712 adapted to mate with cable 420 and to hold cable 420 in contact with surface 708. Bracket 710 may be secured to surface 708 using screws 716 or the like. Strain-relief 706 may further include a resilient material 714. Resilient material 714 helps distribute the clamping forces of bracket 710 across cable 420. Resilient material 714 further prevents rigid bracket 710 from damaging cable 420.

Strain-reliefs 422,424 should be positioned just outside (i.e., away from curved portion 426(3)) of line segments 502,504 (see FIGS. 5 and 6). As discussed above with reference to FIG. 5, however, the position of line segments 502,504 changes as interconnection 400 is rotated (i.e., member 404 is rotated with respect to member 402). This is explained in detail below.

Line segments 502,504 are parallel to and co-planar (i.e., common to plane 506) with central line 508 of the bend. As interconnection 400 is rotated, central line 508 rotates at a rate one-half that of member 404. See FIG. 8.

Figure 8:
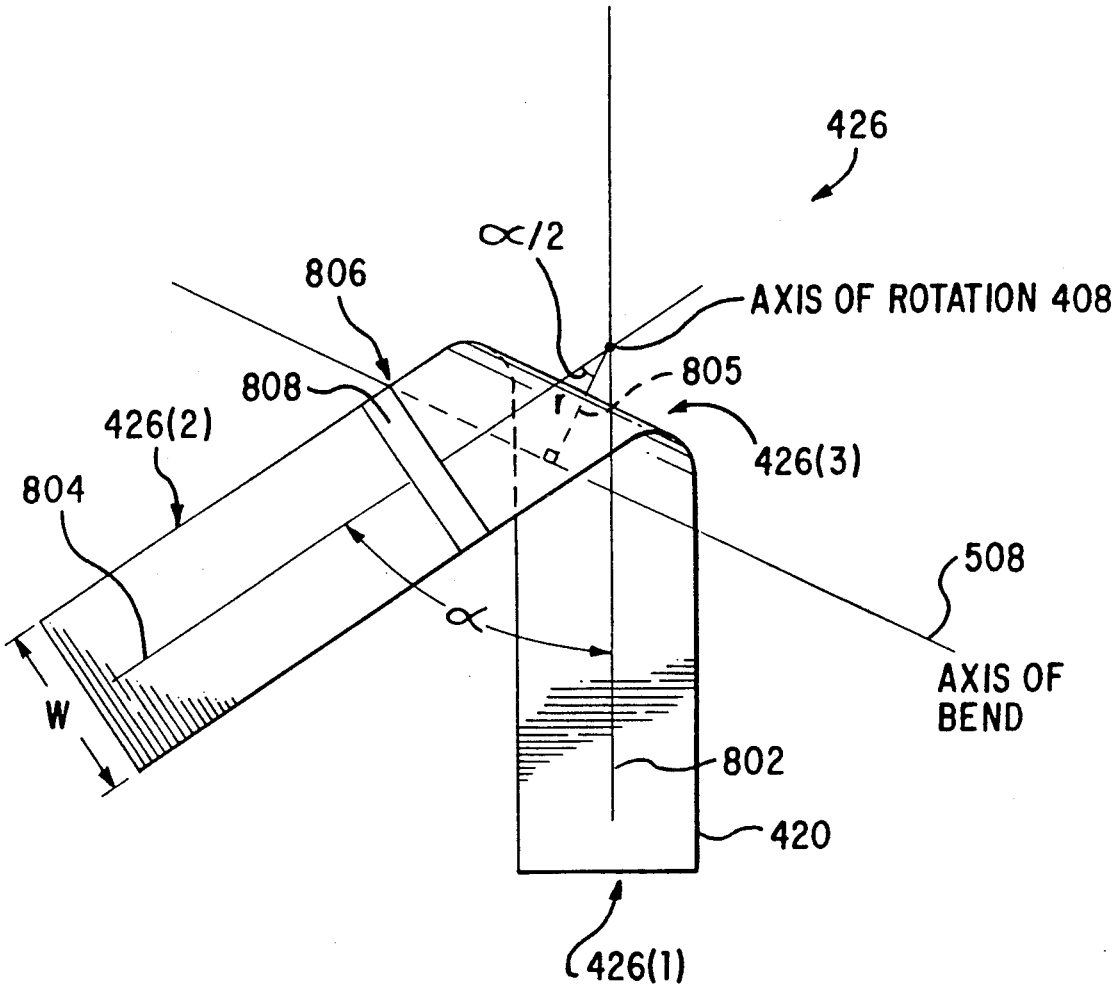
FIG. 8 is a top view of a portion of cable folded into a "U" shape to illustrate the geometric relationships between the central line of the bend and the axis of rotation.

FIG. 8 illustrates interconnection 400 with members 402,404 removed. Longitudinal portion 426(1) includes a longitudinal axis 802 which lies in a plane formed by surface 510 (see FIGS. 5 and 6). Longitudinal portion 426(2) includes a longitudinal axis 804 which lies in a plane formed by surface 512. Longitudinal axes 802,804 intersect at the point (axis) of rotation 408 if FIG. 8 is viewed as two-dimensional (i.e., ignore the dimension defined by the axis of rotation 408). Longitudinal portion 426(2) is rotated with respect to longitudinal portion 426(1) to form an angle $\alpha$ between longitudinal axis 802 and longitudinal axis 804.

Central line 508 of the bend rotates with longitudinal portion 426(2) to form an angle $\alpha/2$. A radial line 805 extending from the axis of rotation 408 to central line 508 of the bend represents distance r. Radial line 805 remains perpendicular to central line 508 of the bend and distance r remains constant as interconnection 400 is rotated. Recall that as central line 508 rotates, plane 506 follows, causing line segments 502,504 to cut diagonally across cable 420. This shifting of line segments 502,504 is caused by a twisting of cable 420 which occurs when interconnection 400 is rotated.

Point 806 represents the nearest point to the axis of rotation 408 that a strain-relief 808 could be placed if an angle $\alpha$ of rotation (in each direction; total angle $=2\alpha$) is desired. The location of point 806 can be determined as follows.

Figure 9:
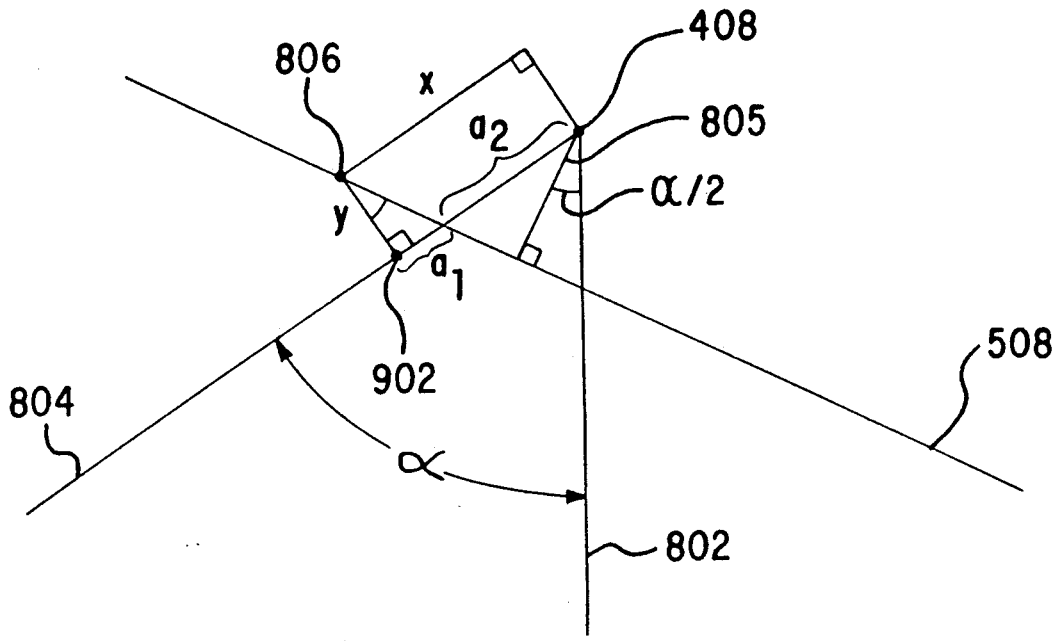
FIG. 9 is a diagram abstracted from FIG. 8 to simplify the geometric relationships between the central line of the bend and the axis of rotation.

FIG. 9 is a simplified geometric diagram of FIG. 8. Lines x and y have been added to form a rectangle which includes point 806 and center (axis) of rotation 408 as diagonal corners. If the length of lines x and y can be determined, then the location of point 806 can be ascertained. From inspection of FIGS. 8 and 9, it can be seen that y is equal to one-half the width (i.e., W/2) of cable 420. x is equal to the sum of line segments $\alpha_1$ and $\alpha_2$ where:

$$a_1 = y\tan\left(\frac{\alpha}{2}\right) = \frac{W}{2}\tan\left(\frac{\alpha}{2}\right)$$

-continued $$a_2 = \frac{r}{\cos\left(\frac{\alpha}{2}\right)} = \frac{\frac{1}{2}(2.184)d}{\cos\left(\frac{\alpha}{2}\right)}$$

Thus, $$x = a_1 + a_2 = \frac{W}{2}\tan\left(\frac{\alpha}{2}\right) + \frac{\frac{1}{2}(2.184)d}{\cos\left(\frac{\alpha}{2}\right)} = \frac{W\sin\left(\frac{\alpha}{2}\right) + 2.184\,d}{2\cos\left(\frac{\alpha}{2}\right)}$$

x is equal to the distance from the center of rotation 408 to the center point 902 of longitudinal axis 804 (where a strain-relief would cross).

In the preferred embodiment described above, cable 420 is sandwiched between two surfaces (e.g., surfaces 510,512). This produces an optimal interconnection because surfaces 510,512 limit the range of motion of cable 420. Situations, however, can be imagined where two juxtaposed surfaces are not available for implementing interconnection 400. Two examples of such a situation are shown in FIGS. 10(*a*) and (*b*).

Figure 10A:
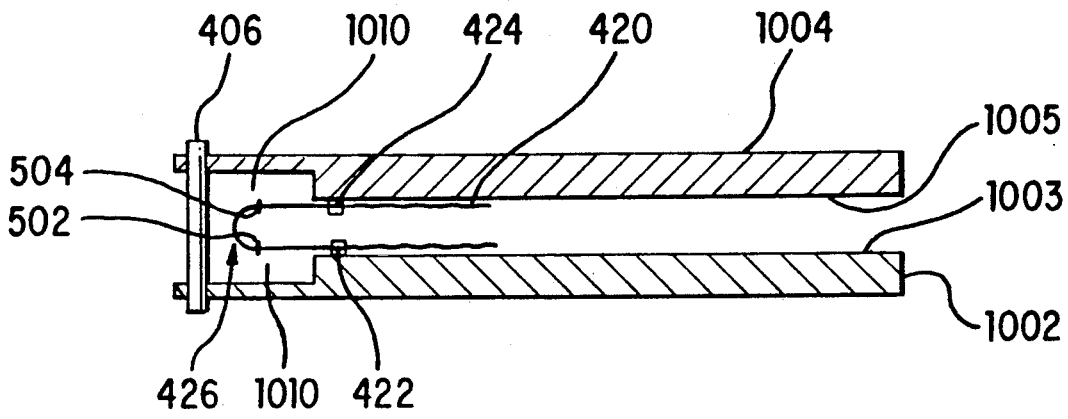
FIG. 10(*a*) is a side view of the interconnection of the invention used in a mechanical system where the "U" shaped portion of the cable is not restrained in its range of motions by juxtaposed surfaces.
Figure 10B:
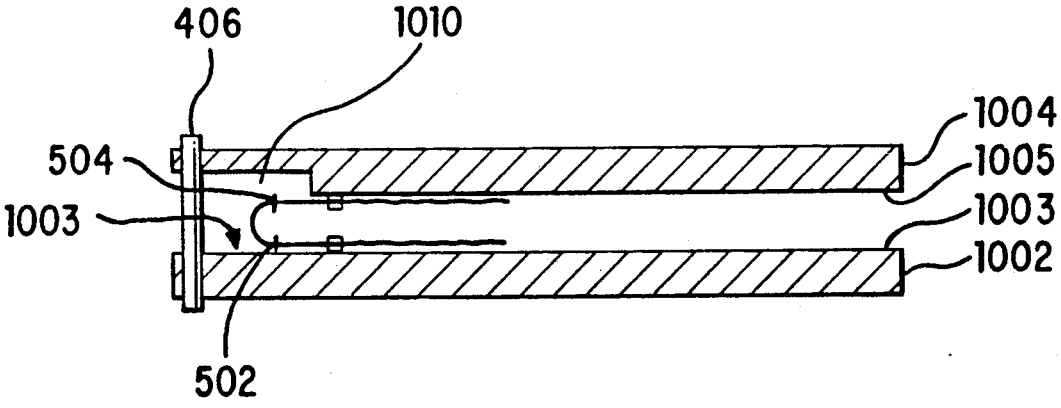

FIG. 10(*a*) shows an alternate embodiment of the rotatable interconnection 400 of the invention. Interconnection 400 is formed between two members 1002,1004 which are rotatably coupled by a coupling pin 406. Member 1002 has a surface 1003 which is juxtaposed to a surface 1005 of member 1004. Note that each of surfaces 1003,1005 has a recessed portion 1010 adjacent to line segments 502,504 of "U" shaped portion 426. Recessed portions 1010 prevent surfaces 1003,1005 from contacting cable 420 at line segments 502,504. Recessed portions 1010 result in an increased freedom of movement for cable 420. Increased freedom of movement brings with it decreased predictability and new stresses.

FIG. 10(*b*) is identical to FIG. 10(*a*), except that member 1002 does not have a recessed portion 1010. This allows line segment 504 of "U" shaped portion 426 to rest against surface 1003.

In both of these embodiments of FIGS. 10(*a*) and 10(*b*), the ideal situation for implementation of the interconnection of the invention is not present. Nonetheless, a useful rotating interconnection which is an improvement over the conventional art is produced. Thus, while it is preferred that "U" shaped portion 426 be sandwiched between two surfaces, it is not necessary.

Heretofore, the invention has been described as an apparatus for providing rotation in a single plane. If rotation in more than one plane is desired, then two mechanical coupling must be used. A first coupling would allow rotation in a first plane. A second coupling would allow rotation in a second plane. The second plane, for example, could be orthogonal to the first plane. Each coupling could employ the rotatable interconnection of the invention.

While the invention has been particularly shown and described with reference to a preferred embodiment thereof, it will be understood by those skilled in the art that various changes in form and details may be made therein without departing from the spirit and scope of the invention.

We claim:

1. A mechanical system comprising:

a first member defining a first surface;

a second member defining a second surface, said first and second members being coupled for relative rotation about an axis, said first and second surfaces being separated in a juxtaposed relationship by a distance d; and an electrical interconnection which allows electrical signals to pass between a first point on said first surface to a second point on said second surface, the interconnection including a flexible cable fixedly attached to said first surface at said first point and said second surface at said second point and forming a "U" shaped portion therebetween, said "U" shaped portion being disposed between said first and second surfaces such that said axis is adjacent to an apex of said "U" shaped portion and such that said "U" shaped portion opens away from said axis.

2. A mechanical system comprising:

a first member defining a first surface;

a second member defining a second surface, said first and second members being coupled along an axis for relative rotation, said first and second surfaces being separated in a juxtaposed relationship by a distance d;

an electrical interconnection which allows electrical signals to pass between a first point on said first surface to a second point on said second surface, the interconnection including a flexible cable fixedly attached to said first surface at said first point and said second surface at said second point and forming a "U" shaped portion therebetween, said "U" shaped portion including a curved portion which defines a central line of the bend of said curved portion, said "U" shaped portion being disposed such that said central line of the bend is located a distance from said axis substantially equal to 1.092 times distance d.

3. The mechanical system of claim 2, further comprising a first strain-relief cable mount and a second strain-relief cable mount, said first strain-relief cable mount securing said flexible cable to said first surface, said second strain-relief cable mount securing said flexible cable to said second surface.

4. The mechanical system of claim 3, wherein said flexible cable is a flexible printed circuit.

5. The mechanical system of claim 3, wherein said flexible cable is a ribbon cable.

6. A mechanical system comprising:

a first member defining a first surface;

a second member defining a second surface, said first and second members being coupled along an axis for relative rotation about a plane of rotation, said first and second surfaces being separated in a juxtaposed relationship by a distance d;

an electrical interconnection which allows electrical signals to pass between a first point on said first surface to a second point on said second surface, the interconnection including:

a flexible cable, said cable being fixedly attached to said first surface at said first point and being fixedly attached to said second surface at said second point and forming a "U" shaped portion therebetween, said "U" shaped portion including:

a first longitudinal portion substantially parallel to said plane of rotation, a second longitudinal portion substantially parallel to said plane of rotation, and a curved portion connecting said first and second longitudinal portions, said curved portion defining a central line of the bend of said curved portion which is substantially parallel to said plane of rotation, said "U" shaped portion being disposed such that said central line of the bend is located a distance r from said axis, where r is substantially equal to 1.092 times distance d.

7. The mechanical system of claim 6, wherein said flexible cable is a flexible printed circuit.

8. The mechanical system of claim 6, further comprising a first strain-relief cable mount and a second strain-relief cable mount, said first strain-relief cable mount securing said flexible cable to said first surface, said second strain-relief cable mount securing said flexible cable to said second surface.

9. The mechanical system of claim 8, wherein distance d is selected such that compressional restoring forces of said curved portion of said flexible cable maintain said first longitudinal portion of said "U" shaped portion of said flexible cable in substantial contact with said first surface and said second longitudinal portion of said "U" shaped portion of said flexible cable in substantial contact with said second surface.

10. The mechanical system of claim 9, wherein said flexible cable is a flexible printed circuit.

11. The mechanical system of claim 9, wherein said flexible cable is a ribbon cable.

12. In a mechanical system having a first member defining a first longitudinal axis and a first surface, and a second member defining a second longitudinal axis and a second surface, wherein the first member and the second member are coupled for rotation about an axis of rotation such that the first and second surfaces are juxtaposed and are separated by a distance d, and such that the axis of rotation is substantially perpendicular to the first and second longitudinal axes, an electrical interconnection which allows electrical signals to pass between a first point on the first surface to a second point on the second surface, the interconnection comprising:

a flexible cable, said cable being fixedly attached to the first surface at the first point and being fixedly attached to the second surface at the second point and forming a "U" shaped portion therebetween, said "U" shaped portion including:

a first longitudinal portion substantially parallel to said first axis, a second longitudinal portion substantially parallel to said second longitudinal axis, and a curved portion connecting said first and second longitudinal portions, said curved portion defining a central line of the bend of said curved portion, said "U" shaped portion being disposed such that said central line of the bend is located a distance substantially equal to 1.092 times distance d from the axis of rotation.

13. The electrical interconnection of claim 12, wherein said flexible cable is a flexible printed circuit.

14. The electrical interconnection of claim 13, wherein said flexible cable is fixedly attached to said first surface using a first strain-relief cable mount, and wherein said flexible cable is fixedly attached to said second surface using a second strain-relief cable mount.

15. The electrical interconnection of claim 14, wherein distance d is selected such that compressional restoring forces of said curved portion of said flexible cable maintain said first longitudinal portion of said "U" shaped portion of said flexible cable in substantial contact with said first surface and said second longitudinal portion of said "U" shaped portion of said flexible cable in substantial contact with said second surface.

* * * * *